United States Patent [19]

Finley

[11] 4,361,278

[45] Nov. 30, 1982

[54] IRRIGATION SPRINKLER

[76] Inventor: Donald J. Finley, Rte. 1, Box 77, Breckenridge, Tex. 76024

[21] Appl. No.: 209,430

[22] Filed: Nov. 24, 1980

[51] Int. Cl.[3] ..... B05B 7/00

[52] U.S. Cl. ..... 239/8; 239/231; 239/428.5

[58] Field of Search ..... 239/8, 11, 225, 230, 239/231, 233, 428.5, 589

[56] References Cited

U.S. PATENT DOCUMENTS

| | | | |
|---|---|---|---|
| 1,751,719 | 3/1930 | Uhri | 239/8 |
| 1,901,225 | 3/1933 | Butler | 239/233 |
| 2,366,354 | 1/1945 | Robbins | 239/428.5 |
| 2,388,508 | 11/1945 | Timpson | 239/428.5 X |
| 2,564,060 | 8/1951 | Gettins | 239/428.5 |
| 2,619,380 | 11/1952 | Jepson | 239/233 |
| 3,918,647 | 11/1975 | Lamz et al. | 239/428.5 |

FOREIGN PATENT DOCUMENTS

| | | | |
|---|---|---|---|
| 148713 | 8/1950 | Australia | 239/231 |
| 43095 | 3/1958 | Poland | 239/428.5 |
| 1018431 | 1/1966 | United Kingdom | 239/428.5 |

*Primary Examiner*—Johnny D. Cherry

*Attorney, Agent, or Firm*—Richards, Harris & Medlock

[57] ABSTRACT

An irrigation sprinkler which produces a high-velocity core stream and a pulsating low-velocity peripheral stream is provided. The irrigation sprinkler includes an aeration chamber having an aeration port through which air enters the aeration chamber and mixes with the outer surface of a stream of water passing through the aeration chamber.

3 Claims, 3 Drawing Figures

IRRIGATION SPRINKLER

TECHNICAL FIELD

This invention relates to irrigation sprinkler devices for use in watering lawns, farms, golf courses and the like and more particularly to an irrigation sprinkler having an output wherein a high-velocity core stream of water is surrounded by a peripheral low-velocity stream produced by passing a water stream through a chamber wherein air is mixed with the outer surface of the water stream.

BACKGROUND ART

Slow watering long range sprinklers are often used to irrigate large areas such as farms, lawns, golf courses and the like. One commonly used irrigation device is an impact sprinkler having a vane, hammer and anvil assembly to provide motive force for rotating a sprinkler head. The vane pivots on a shaft centered on the assembly and is spring-loaded. The spring in the at-rest condition positions the vane into the path of a solid stream of water directed generally upward and outward. The stream forces the vane to rotate in a direction opposite to the desired sprinkler head rotation. The spring limits this vane rotation and returns it to the at-rest position for repetition. As the vane reaches the at-rest position the attached hammer strikes an anvil which is attached to the sprinkler head. The degree of rotation is limited by the inertia of the hammer and sprinkler head and by a compression spring which loads a thrust bearing upon which the sprinkler head rotates. Thus, in this device the sprinkler head is caused to slowly rotate in a series of small steps.

In irrigating large areas it is necessary to evenly distribute the water flow to the area being sprinkled. In the prior art device described above, the vane moves into and out of the stream breaking the stream into small drops. The velocities of the drops thereby produced are much lower compared to the velocity of the stream, and thus the drops fall to the ground after traveling relatively short distances. These drops provide short and intermediate sprinkling of the area being irrigated. The stream irrigates at long range with large drops during intervals when it is not in contact with the vane. Impact sprinklers commonly provide somewhat less water at intermediate ranges than at short and long ranges. Further, moving parts require maintenance and wear out, causing premature failure of the sprinkler.

A need has thus arisen for a large area irrigation sprinkler that is simple in operation, low in cost, and effective in short, intermediate and long range irrigation.

DISCLOSURE OF THE INVENTION

The present invention is an irrigation sprinkler having a nozzle which ejects a stream of water through a chamber and out a port at the end of the chamber. A partial vacuum is created within the chamber by the passage of the stream of water therethrough. An aeration port in the chamber allows air to be drawn into the chamber. Air in the chamber mixes with the outer surface of the stream and produces a diffuse divergent low-velocity peripheral stream of water surrounding a high-velocity core stream of water. The aeration port may be placed such that water trapped within the chamber intermittently interrupts air flow through the aeration port resulting in a surging peripheral stream. A vane placed in the path of the surging peripheral stream provides a pulsating rotational force to rotate the sprinkler on a rotatable spindle housing.

BRIEF DESCRIPTION OF THE DRAWINGS

A more complete understanding of the invention and its advantages will be apparent from the Detailed Description taken in conjunction with the accompanying Drawings in which.

DETAILED DESCRIPTION

Figure 1:
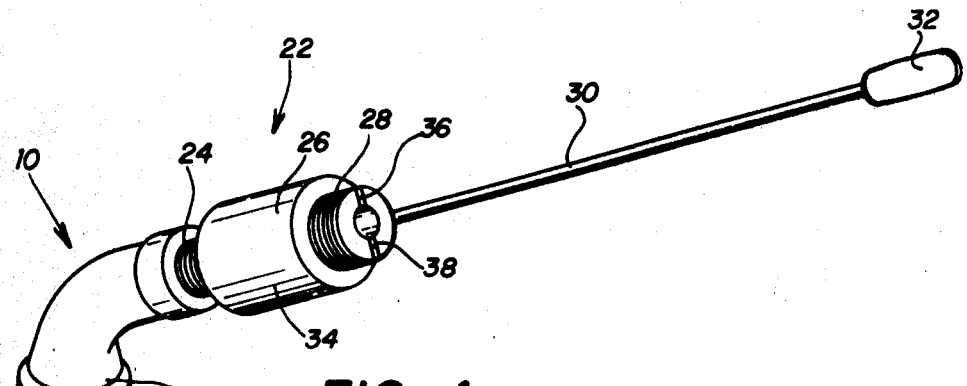
FIG. 1 is a perspective view of an irrigation sprinkler equipped for carrying out the invention.

Referring initially to FIG. 1, the present irrigation sprinkler 10 includes a threaded base 12 for mounting of sprinkler 10 to a water source. Threaded base 12 may be attached to a fixed irrigation system or, alternatively, to a stand for portable use in combination with a water hose. Threaded base 12 is rotatably mounted on spindle 13 which is threaded and attached to body 14. Bearing washer 16, spring 18, and shoulder 20 formed on spindle 13 enable spring 13 and body 14 to freely rotate about threaded base 12.

FIG. 1 further shows an aeration chamber indicated generally by the numeral 22. Aeration chamber 22 includes nozzle 24, chamber body 26 and outlet port 28. Vane 32 extends from chamber body 26 on extension 30. Aeration port 34 is provided in chamber body 26. In the preferred embodiment, outlet port 28 is an externally threaded body having slots 36 and 38 which allow easy removal of outlet port 28 for inspection of aeration chamber 22 or the substitution of a differently sized outlet port 28. Outlet port 28 is fabricated using tapered pipe threads, and mating interior threads are provided in chamber body 26.

Figure 2:
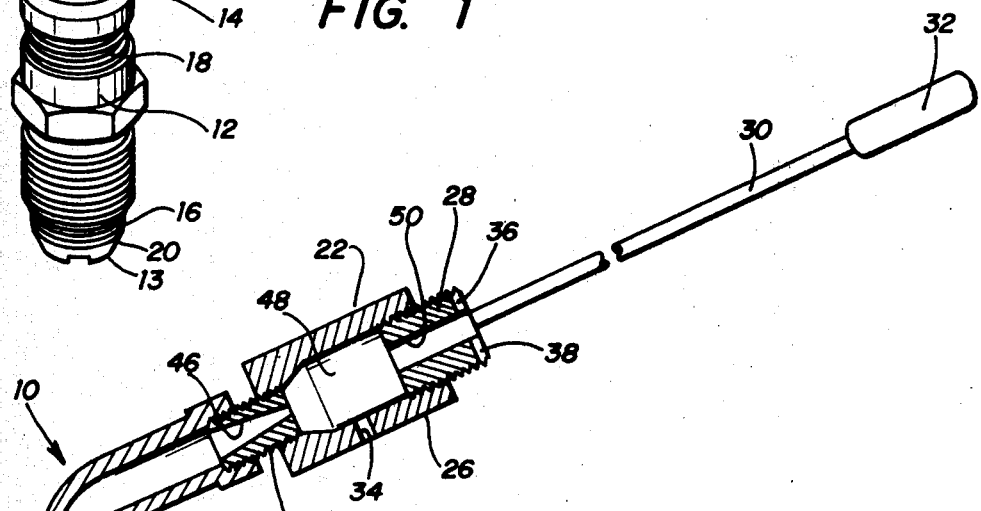
FIG. 2 is a sectional view of the sprinkler of FIG. 1.

In FIGS. 1 and 2, like numerals are used for like and corresponding elements. Nozzle 24 is an externally threaded body having a convergent interior bore 46. Tapered pipe threads are provided on each end of nozzle 24, and mating interior threads are provided in body 14 and chamber body 26. Nozzle 24, chamber body 26 and outlet port 28 are sized to provide a cavity 48 within chamber body 26. Outlet port 28 includes outlet bore 50 which is a cylindrical bore having a diameter greater than that of the converging interior bore 46 at its smallest diameter. Chamber body 26 includes aeration port 34 passing therethrough and allowing communication between cavity 48 and the exterior of chamber body 26.

In operation, water is forced through interior bore 46 of nozzle 24 resulting in a stream of water having a relatively high velocity. The water pressure in body 14 and thus the velocity of the stream may be controlled by a valve or spigot placed downstream of sprinkler 10. Nozzle 24 ejects the stream of water through cavity 48 and outlet bore 50. Outlet bore 50 is concentric to interior bore 46 and is large enough to permit almost all of the stream of water to exit yet small enough to trap a minute amount of water within cavity 48. As the stream exits, a partial vacuum is created within cavity 48 due to the stream pulling air within cavity 48 out outlet bore 50. Aeration port 34 allows air to be pulled by this partial vacuum into cavity 48. The air in cavity 48 mixes with the water in the outer surface of the stream of water, thereby diffusing the surface water as it exits outlet bore 50 into various sizes of droplets and drops. The inner core of the stream as it exits remains a relatively solid high-velocity stream.

Figure 3:
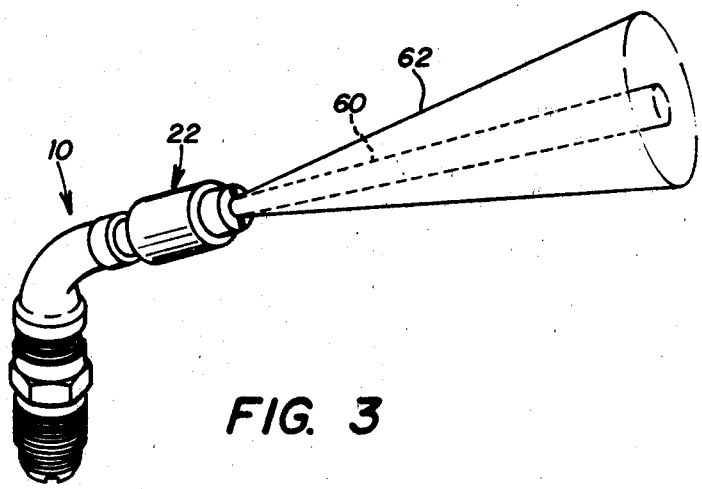
FIG. 3 is a side view of the irrigation sprinkler of FIG. 1 and spray patterns produced thereby.

Thus, as shown in FIG. 3, the output of the present irrigation sprinkler is a relatively high-velocity core stream 60 and a peripheral stream 62 having a much lower velocity. The peripheral stream 62 is formed by the interaction of the stream of water exiting nozzle 24 and air within aeration chamber 22. Core stream 60 remains a relatively solid stream until it breaks up at long range into large drops. Peripheral stream 62 breaks up into smaller drops and falls to the ground at distances relatively close to the placement of irrigation sprinkler 10. This varied breakdown of core stream 60 and peripheral stream 62 provides even coverage of the irrigated area.

The minute amount of water trapped in cavity 48 flows to the bottom surface of cavity 48 and tries to flow out of aeration port 34. This momentary blockage of aeration port 34 creates a momentary narrowing of peripheral stream 62. The water blocking aeration port 34 is pulled by the vacuum in cavity 48 back into the stream of water exiting cavity 48 thereby clearing aeration port 34, and peripheral stream 62 momentarily enlarges. The blockage of aeration port 34 occurs repetitively as water continually is trapped within cavity 48 and ejected. Thus it can be seen that the placement of aeration port 34 at a location where water within the chamber intermittently interrupts the flow of air through aeration port 34 results in a surging or spitting action wherein peripheral stream 62 repetitively narrows and enlarges.

Vane 32 is a stationary vane positioned outside core stream 60 but within the surging peripheral stream 62. Vane 32 is shaped to obtain rotational thrust from peripheral stream 62 and thus provides a motive force for rotating sprinkler 10 slowly in a series of small pulsations.

It has been found that sprinkler efficiency is affected by the relative size of outlet bore 50 in comparison with the size of the stream exiting nozzle 24. If outlet bore 50 is too small, excessive water within cavity 48 results in a high volume, low velocity output with no sprinkling action. On the other hand, insufficient water in cavity 48, a result of outlet bore 50 being sized too largely, results in irregularity or loss of pulsation of peripheral stream 62 and the loss or irregularity of the motive rotational force provided thereby.

The sizing of aeration port 34 also affects sprinkler efficiency. Excessive air intake resulting from aeration port 34 being sized too largely results in a frothy output and poor sprinkler coverage at long range. In contrast, insufficient air intake results in poor sprinkler coverage at short and intermediate ranges. Positioning aeration port 34 to the top or the side of the cavity 48 results in large, random surges caused by water build-up within cavity 48.

In the preferred embodiment, vane 32 is positioned within peripheral stream 62. Positioning vane 32 within core stream 60 results in various combinations of rapid rotation, poor distribution of water, or erratic rotation, depending on the precise location.

Reasonable experimentation by persons having ordinary skill in the irrigation sprinkler art will yield suitable combinations of nozzle interior bores, outlet bores, aeration port diameters, and vane placements to suit various irrigation needs.

It can thus be seen that the present invention provides an irrigation sprinkler having no moving parts in which short range and intermediate area coverage are improved. While only one embodiment of the present invention has been described in detail herein and shown in the accompanying Drawings, it will be evident that various further modifications are possible without departing from the scope of the invention.

I claim:

1. An irrigation sprinkler comprising:

(a) a sprinkler body rotatably mounted on a source of water such that said sprinkler body may rotate on an axis;

(b) a nozzle attached to said sprinkler body having an interior bore for radially outward and generally upward ejection of a stream of water from said nozzle;

(c) an aeration chamber attached to said nozzle having a side wall, an outlet port, and an aeration port, said outlet bort being downstream of said nozzle and said outlet port being of a greater diameter than said interior bore of said nozzle, said aeration port being disposed in said side wall such that air enters a cavity within said aeration chamber through said aeration port and mixes with said stream of water ejected from said nozzle to form a core stream and a peripheral low-velocity stream; and (d) said aeration port being located in said side wall of said aeration chamber at a location such that a quantity of water retained within said cavity of said aeration chamber intermittently blocks said aeration port thereby causing repetitive surging of said peripheral low-velocity stream.

2. The irrigation sprinkler of claim 1 further comprising a vane disposed within said repetitively surging peripheral low-velocity stream such that a pulsating rotational force is applied to said irrigation sprinkler.

3. A method of irrigation sprinkling comprising:

ejecting from a sprinkler body a water stream having a core stream surrounded by a peripheral stream having a lower velocity than that of said core stream;

forming said peripheral stream by mixing air with an outer surface of said core stream;

deflecting a portion of said peripheral stream thereby imparting rotational motion to said sprinkler body; and intermittently interrupting said mixing of air into said core stream outer surface such that said peripheral stream surges repeatedly.

* * * * *